US005732858A

United States Patent [19]

Plastino

[11] Patent Number: 5,732,858

[45] **Date of Patent: *Mar. 31, 1998**

[54] AUTO MOLD MACHINE FOR HATS

[76] Inventor: Mario A. Plastino, 40 Roneck Ct., Shirley, N.Y. 11967

[ * ] Notice: The term of this patent shall not extend beyond the expiration date of Pat. No.5, 590,820.

[21] Appl. No.: 666,867

[22] Filed: Jun. 19, 1996

Related U.S. Application Data

[63] Continuation-in-part of Ser. No. 599,633, Feb. 9, 1996, Pat. No. 5,590,820.

[51] Int. Cl.[6] ..... A42C 1/04

[52] U.S. Cl. ..... 223/12; 223/7; 223/57; 425/395; 425/412

[58] Field of Search ..... 223/12, 13, 24, 223/26, 52, 57, 7; 425/398, 412, 416; 264/324

[56] References Cited

U.S. PATENT DOCUMENTS

| | | | |
|---|---|---|---|
| 755,365 | 3/1904 | Cuming | 223/12 |
| 1,392,605 | 10/1921 | Stevens | 223/12 |
| 2,370,553 | 2/1945 | Lomitzo | 223/57 |
| 2,754,530 | 11/1956 | Cottrell et al. | 223/12 |
| 4,684,934 | 8/1987 | Kiss | 425/87 |

FOREIGN PATENT DOCUMENTS

| | | | |
|---|---|---|---|
| 4720015 | 2/1971 | Japan | 425/412 |
| 282500 | 10/1927 | United Kingdom | 223/12 |

OTHER PUBLICATIONS

Advertisement for two hat making machines, Michelagnoli, Florence, Italy, undated.

"Headware Engineering, pp. 9–11 and Hats are Made" pp. 38–42 in *How Hat Life Yearbook and Directory*, 1984–85 Edition, Pellon Corporation, New York, New York.

*Primary Examiner*—Bibhu Mohanty
*Attorney, Agent, or Firm*—Alfred M. Walker

[57] ABSTRACT

A hat molding machine using advanced features will produce a completed hat form from an unshaped felt or wool configuration. The machine employs male and female hat molds. The female hat mold has embedded electric heating elements which are temperature controlled. Low pressure steam is piped into the female mold. Using three pneumatic cylinders and an automatic programmable air controller with timer for proper sequencing, a completed hat form shape including shape portion and flange brim portion results.

22 Claims, 9 Drawing Sheets

AUTO MOLD MACHINE FOR HATS

This application is a continuation-in-part of applications Ser. No. 08/599,633 filed Feb. 9, 1996 now U.S. Pat. No. 5,590,820.

FIELD OF THE INVENTION

The hat molding machine of the present invention uses advanced features to produce a completed hat form of various hat sizes from an unshaped felt, wool or straw configuration. The machine employs male and female hat molds. The female hat mold has embedded electric heating elements which are temperature controlled. Low pressure steam is piped into the female mold. Using three pneumatic cylinders and an automatic programmable air controller with timer for proper sequencing, a completed hat form shape including crown shape portion and flange brim portion results. To vary the size of the hat, the male and female crown portions of the mold are interchangeable.

BACKGROUND OF THE INVENTION

Fur or wool felt hats start out as a cone that is roughly shaped to a raw body by stretching. It is then further processed in a labor-intensive sequence of steps to the familiar hat shape. Two theories of the formation of felt itself, the intertwining and plastic theories, seem to be the basis also for the later steps of hat shaping. According to the intertwining theory, the fibers are mechanically manipulated and forced among each other. The plastic theory holds that the fur or wool fibers become temporarily plastic at elevated temperatures. The hand process involves blocking the crown and flanging the brim.

Skilled crafts people using simple fixtures or machines can perform these operations. Crown stretching is done on a fixture which has a frame over which the rough felt cone is placed. Metal fingers press the felt at the tip between frame members thereby stretching it. The brim stretcher also uses metal fingers to grip the brim to stretch it to shape. The hat is then roughly blocked into shape by wetting and then pulling it over a wooden block. The final blocking steps for final size are done with the aid of steam and an iron. The hat form is finally finished on a hand-carved block that produces the final style or "character" of the shape.

More sophisticated machines for automating some of the steps in hat making have been around for over a hundred years. Starting with a raw felt body, one process involves forming the brim flange by stretching this region using metal fingers before applying steam. The body with the formed brim is then dried on a rack. The dry hat is then put into a female mold and a rubber bladder is inserted in the crown portion and expanded by hydraulic pressure so that the crown is expanded into intimate contact with the female mold. Michelangnoli, a company in Signa, Italy, makes an automatic machine based on this hydraulic principle. Other machines, such as automatic stampers, are used to achieve a final shape to the hat form. Hat sizes are varied by changing the size of the crown portion worn upon the head. Hat sizes are generally characterized as either "small", "medium" or "large". The "small" men's hat size varies between 20 and 21.5 inches in circumference. The "medium" men's hat size varies between 22 inches and 23 inches in circumference and the "large" men's hat size varies between 23.5 and 24.5 inches in circumference. Equivalent size gradations are also applicable for women's hat sizes.

Within each size, the circumferences are varied by adding adjustable trim bands, such as sweat bands, to vary the size of the hat within a particular size.

For example, a "medium" men's hat size will vary between 22 and 23 inches circumference by adding adjustable trim bands therein.

However, to vary the hat size in conventional hat making machines is both time consuming and cumbersome.

OBJECTS OF THE INVENTION

It is an object of this invention to eliminate the manual or separate machine steps of blocking and flanging of hat making.

It is yet another object to produce various size hats in an efficient manner.

It is a further object to mold an average of fifty western hat forms in felt or wool per hour.

It is yet a further object to reduce the skill level of the hat making machine operator and to improve hat making yields compared to manual operations or those using prior art machines.

It is also an object to make molded hat bodies that maintain felt or wool thickness at the brim and crown, which is presently a limitation of the prior art machines.

By using steam and controlled heat, it is an object of this invention to form both the crown and brim portions of a hat in a single automated process.

It is yet another object to manually set up a hat making machine which can be set for a particular cycle and then switched to an automatic operation for the remainder of a production run.

It is yet another object to improve over the disadvantages of the prior art.

SUMMARY OF THE INVENTION

In keeping with these objects and others which may become apparent, the present invention includes an automatic molding machine for pressed items, such as hats using advanced features which produce a pressed items, such as a completed hat form from an unshaped configuration of a moldable material, such as felt, wool or straw.

In the preferred embodiment for hat making, the machine employs male and female hat molds. The female hat mold has embedded electric heating elements which are temperature controlled. Low pressure steam is piped into the female mold. Using a source of pressure, such as three pneumatic cylinders, and an automatic programmable air controller with a timer for proper sequencing, a completed hat form shape including crown shape portion and flange brim portion results.

The hat molding machine uses advanced features to produce a completed hat form from an unshaped felt, wool or straw configuration form to a completed hat form shape, including a crown shape portion and a flange brim portion. The hat making machine includes a male hat mold and a reciprocal female hat mold, wherein either one or both may move toward the other mold. The male hat mold includes two separate movable parts, namely an outer brim flange portion with a central orifice to accommodate the insertion of an inner crown portion therethrough. In contrast, the outer brim flange portion of the female mold is integral with the centrally located hollow crown portion of the female mold.

The outer brim flange portion of the male hat mold and the reciprocal brim flange portion of the female hat mold clamp the brim flange portion of the raw unshaped hat form in a tight cavity formed therebetween. The tight cavity formed between the brim flange portion of the male hat mold and the brim flange portion of the female mold takes the place of traditional stretching of the outer portions of the brim with metal finger clamps. In sequence, the outer brim flange portion is first advanced down to squeeze the brim of the raw felt form. Thereafter, the protruding crown portion of the male mold is advanced down toward the hollow crown portion of the female mold, to stretch the crown portion of the raw hat form into the desired crown shape.

As the two portions of the male hat mold are independently advanced toward the respective portions of the female hat mold, the male hat mold and the female hat mold are provided sequentially with a source of heat, such as one or more heating elements and a source of moisture vapor, such as steam.

The source of heat increases the temperature of the male hat mold and the female mold to a predetermined temperature for a predetermined period of time.

Likewise, the source of moisture supplies moisture vapor steam in a gaseous state to the male hat mold at a predetermined pressure and temperature for a second predetermined period of time. The source of heat and the source of moisture vapor are provided sequentially predetermined periods of time sufficient to clamp and squeeze the raw hat form to the desired completed hat shape.

During the sequence of operations, the movements of the movable male hat mold are controlled, and an air controller controls a steam switch and a heater element in a predetermined sequence for a desired duration of time to form a completed hat.

To vary hat sizes, the respective male and female crown mold portions may be interchangeable with other male and female crown mold portions corresponding to varying hat sizes.

In changing a hat size, from a "large" size designation, the largest male crown portion is removed from the male hat mold portion of the hat making machine, and replaced with another smaller male crown portion, such as corresponding to "small" or "medium" hat sizes.

Thereafter, a hollow insert corresponding to either a "small" or "medium" size crown is inserted within the open female crown mold portion to reduce the interior circumference of the crown of the hat being made.

When the upper, male crown mold portion preferably protrudes downward, facing the lower open female crown mold portion, it must be retained by a fastener means from above. The lower female crown mold insert can be held in place by gravity within the larger female crown mold portion.

It is also known that these respective upper and lower locations of the male and female crown portions can be reversed, however, positioning of the male crown mold portion on the bottom and the female crown insert portion on the top requires both portions to be fastened in place.

DESCRIPTION OF THE DRAWINGS

The present invention can best be understood in conjunction with the accompanying drawings, in which.

DETAILED DESCRIPTION OF THE DRAWINGS

Figure 1:
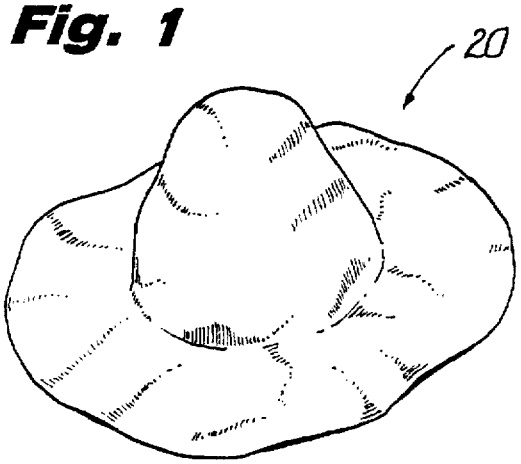
FIG. 1 is a perspective view of raw hat body.
Figure 2:
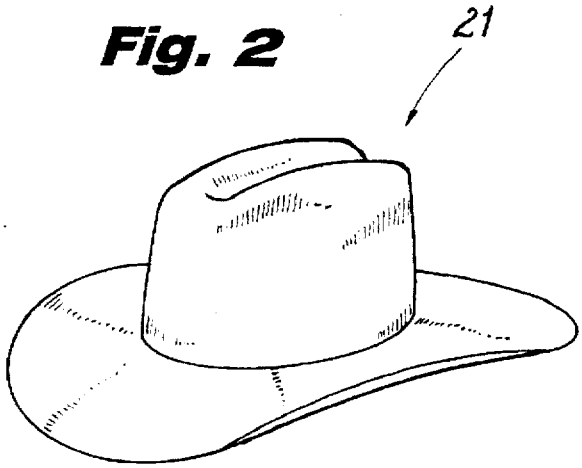
FIG. 2 is a perspective view of a molded hat body.

FIG. 1 shows a prior art raw body 20 of a hat which is a very roughly shaped felt configuration. FIG. 2 shows a molded body 21 or finished hat shaped form. The hat making machine of the present invention starts with the raw body 20 and produces molded body 21.

Figure 3:
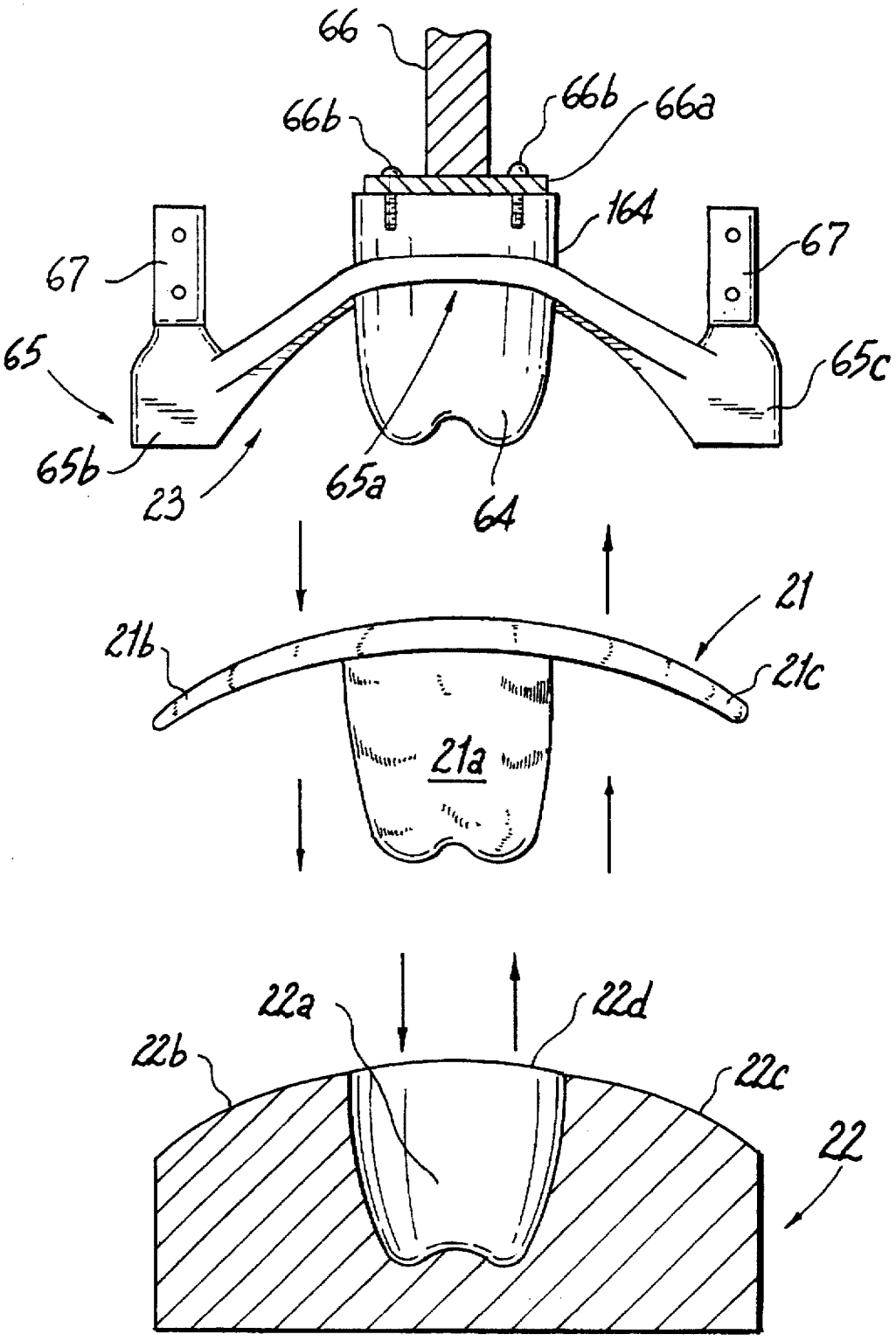
FIG. 3 is a schematic side view of a hat making machine of the present invention showing the relationship between the female mold, male mold and felt hat form.

FIG. 3 shows the relative positions of the female mold 22, the movable male mold 23 and the felt hat 21 being formed sandwiched between. Elements of the machine to be described bear a close relationship to this diagram.

Female mold 22 includes a hollow cavity **22*a* having a shape corresponding to the exterior finished shape of crown portion 21*a* of hat 21. Female mold 22 also includes shoulders 22*b*, 22*c* corresponding the left and right brim portions 21*b*, 21*c* of hat 21**.

While FIG. 3 shows a cutaway sectional view through the center of female mold 22, showing left and right brim portions **22*b*, 22*c* being separated, in reality brim portions 22*b*, 22*c* are the left and right contiguous portions of the annular brim surrounding crown cavity 22*a* of female mold 22 along top edge 22*d*** thereof.

Male mold 23 includes protruding movable male crown mold 64 and flange brim mold 65 having central aperture **65*a* for insertion of male crown mold 64 corresponding therein and left and right shoulders 65*b*, 65*c* corresponding to respective left and right brim portions 21*b*, 21*c* of hat 21**.

Male crown mold 64 is removably attached to coupling plate **66*a* by means of fasteners 66*b*, such as screws, which coupling plate 66*a* is attached to and supported by coupling 66 supporting male crown mold 64** therefrom.

Moreover, flange brim mold 65 is supported by coupling members 67.

As shown in FIG. 3, hat 21 is squeezed between male mold 23 and female mold 22, by virtue of the downward movement of the mold 23 against hat 21 in a raw body shape within female mold 22. As discussed hereinafter, steam and heat is simultaneously applied within female mold 22 while male mold 23 applied mechanical force against both hat 21 and female mold 22, thereby shaping hat 21 to a desired semi-rigid shape.

Figure 3A:
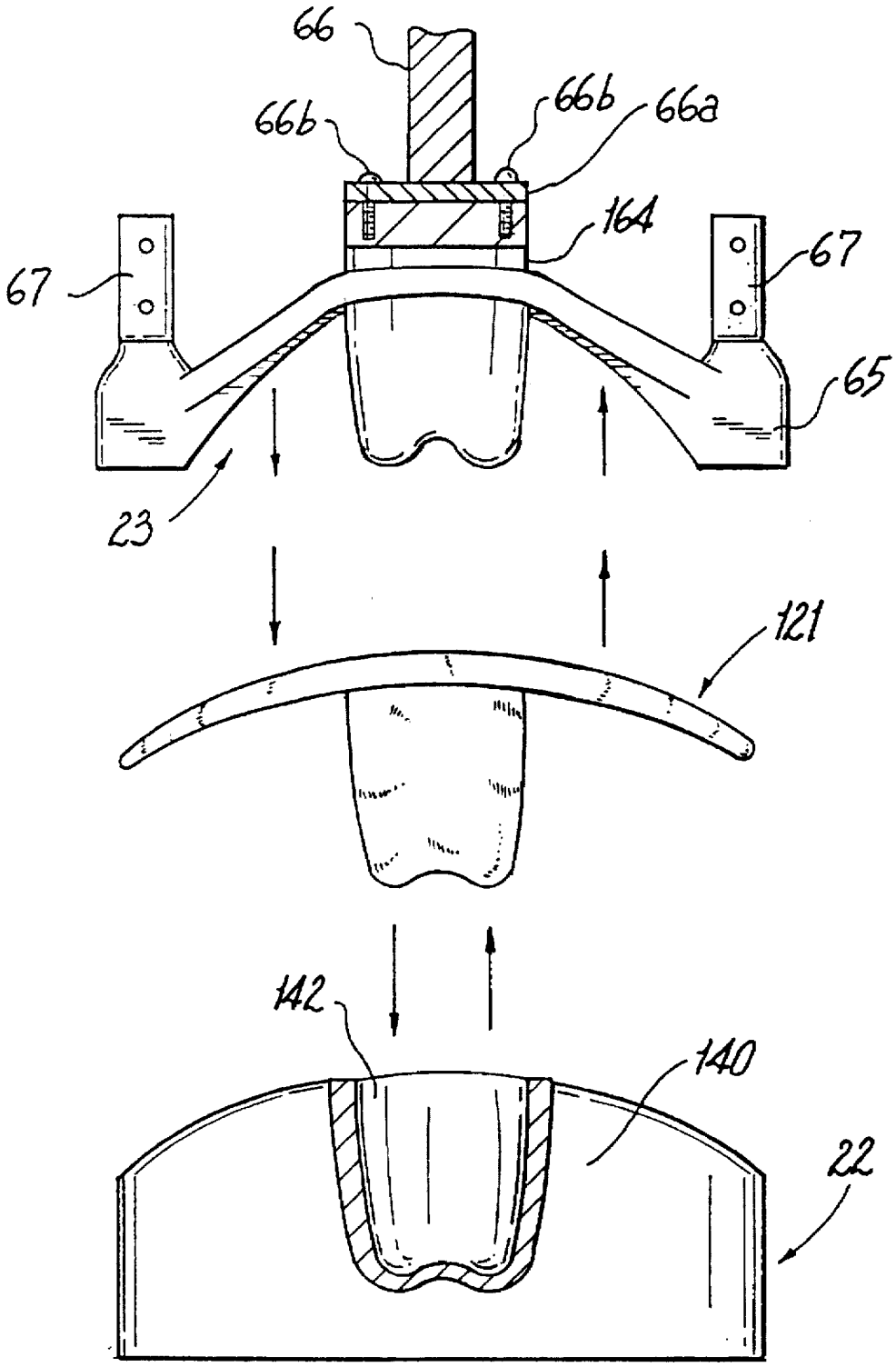
FIG. 3A is a schematic side view of an alternate embodiment for making a smaller size hat.

In the alternate embodiment shown in FIG. 3A, a smaller male crown mold 164 is attached to coupling plate **66*a* by fasteners 66*b*. To reduce the size of female mold cavity 22*a* of female mold 22, insert 140 is inserted therein, to create a smaller cavity 142 for producing a smaller size hat 121**.

The process to be described uses steam, electric heating elements and pressure from pneumatic cylinders to accomplish the molding operation. However, other sources of power, such as hydraulic power and electronic power, may be provided.

Figure 4:
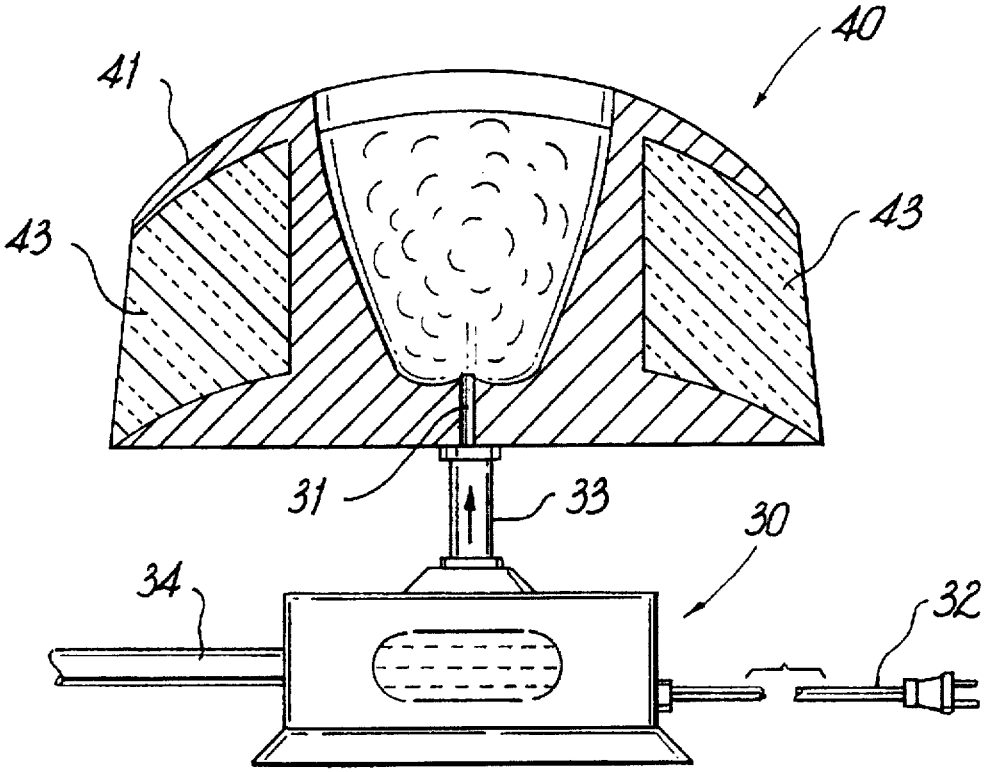
FIG. 4 is a side cross section showing steam use in a female mold of the hat making machine of the present invention.
Figure 5:
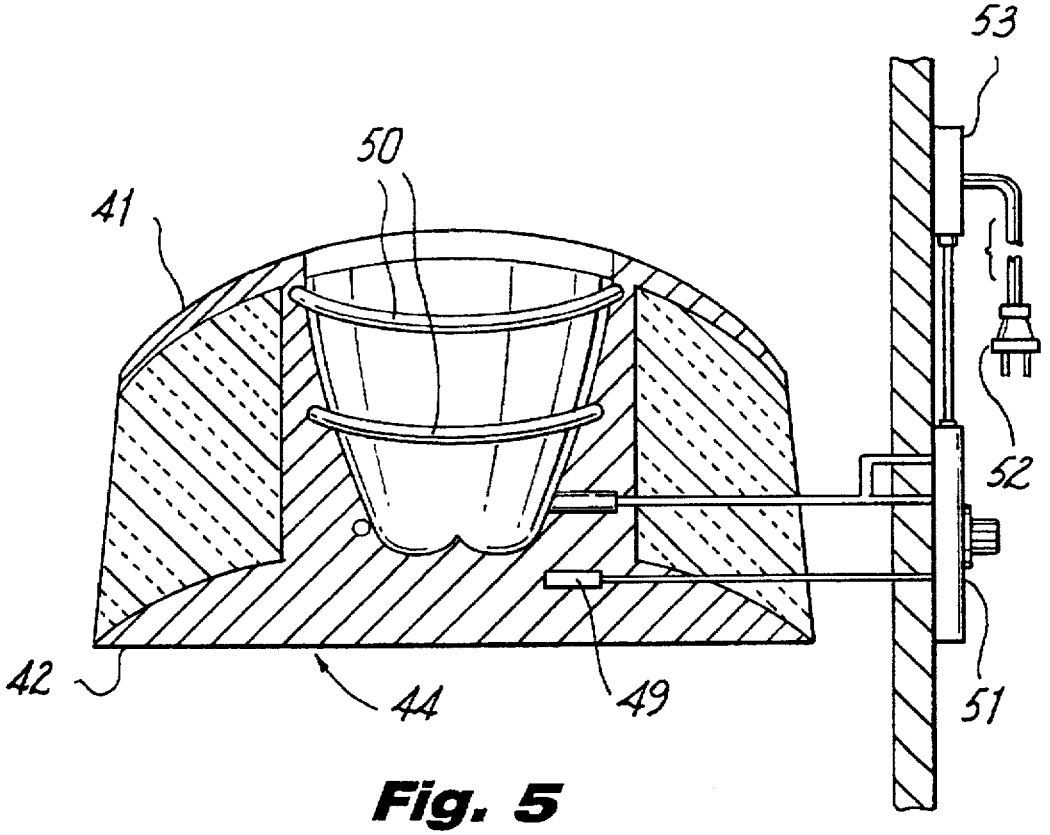
FIG. 5 is a side cross section showing heat rod elements of the female mold of the hat making machine of the present invention.

FIG. 4 shows the female mold with an electrically controlled steam admission valve 30 admitting steam through a small steam port 31 near the base 42 of the female mold assembly 40. The lower flange shape 41 for the brim is shown in partial cross section. The steam source 34 feeds steam through valve 30 to conduit 33 which is in communication with port 31. A plug 32 for electric supply conveys 110 volts AC. Insulating material 43 forms a heat shield around the cast mold 44 of female mold 40. Besides steam, heating rod element 50 wraps in a spiral configuration at strategic locations around female cast mold 44, as shown in FIG. 5. A temperature sensor 49 communicates with thermostat 51 to control the heat rod elements 50. Plug 52 supplies 220 volts AC to junction box 53 to supply the heating elements 50 as well as the "Jiffy" electric steam generator 34 (shown in FIG. 7) which supplies steam at 100 psig. Power line wire 45 connects heat rod 50 to thermostat 51 and junction box 53 and plug 52. Heat rod 50 is controlled to be consistently heated at 250° F.

Figure 6:
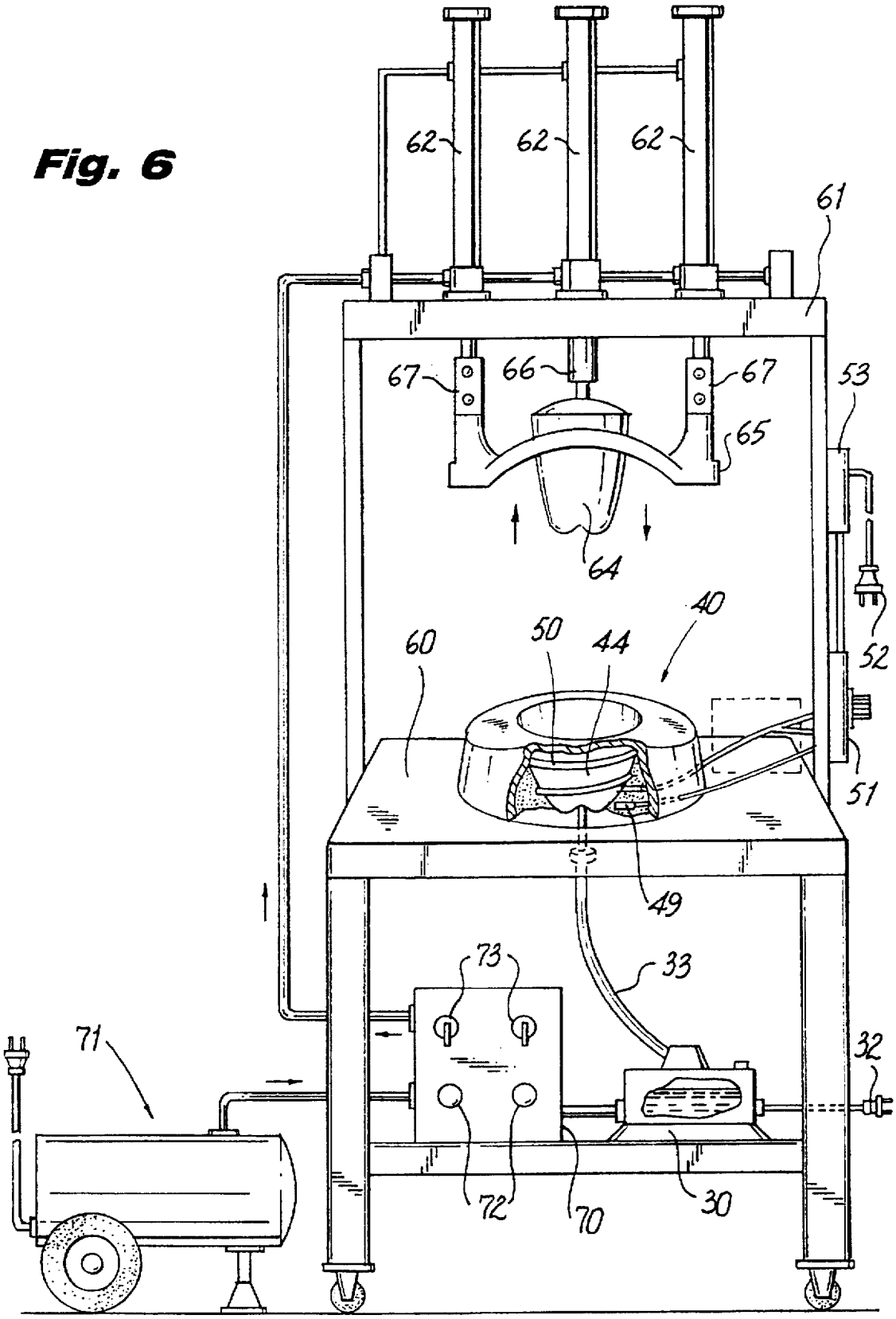
FIG. 6 is a front view of the automatic hat molding machine of the present invention.

FIG. 6 is a front view of the hat molding machine. The female mold subassembly 40 rests on bench 60. Frame assembly 61 supports pneumatic cylinders 62 and 63 as well as movable male mold 23, including flange mold 65 and movable male crown mold 64. The male mold crown shape 64 is attached to the rod of pneumatic cylinder 63 by coupling 66. Cylinders 62 which operate flange (brim) mold 65, are connected to the respective rods via coupling members 67. A pneumatic console 70 receives compressed air from compressor 71. Control button 72 is for automatic cycle operation while controls 73 are for manual operations.

Figure 7:
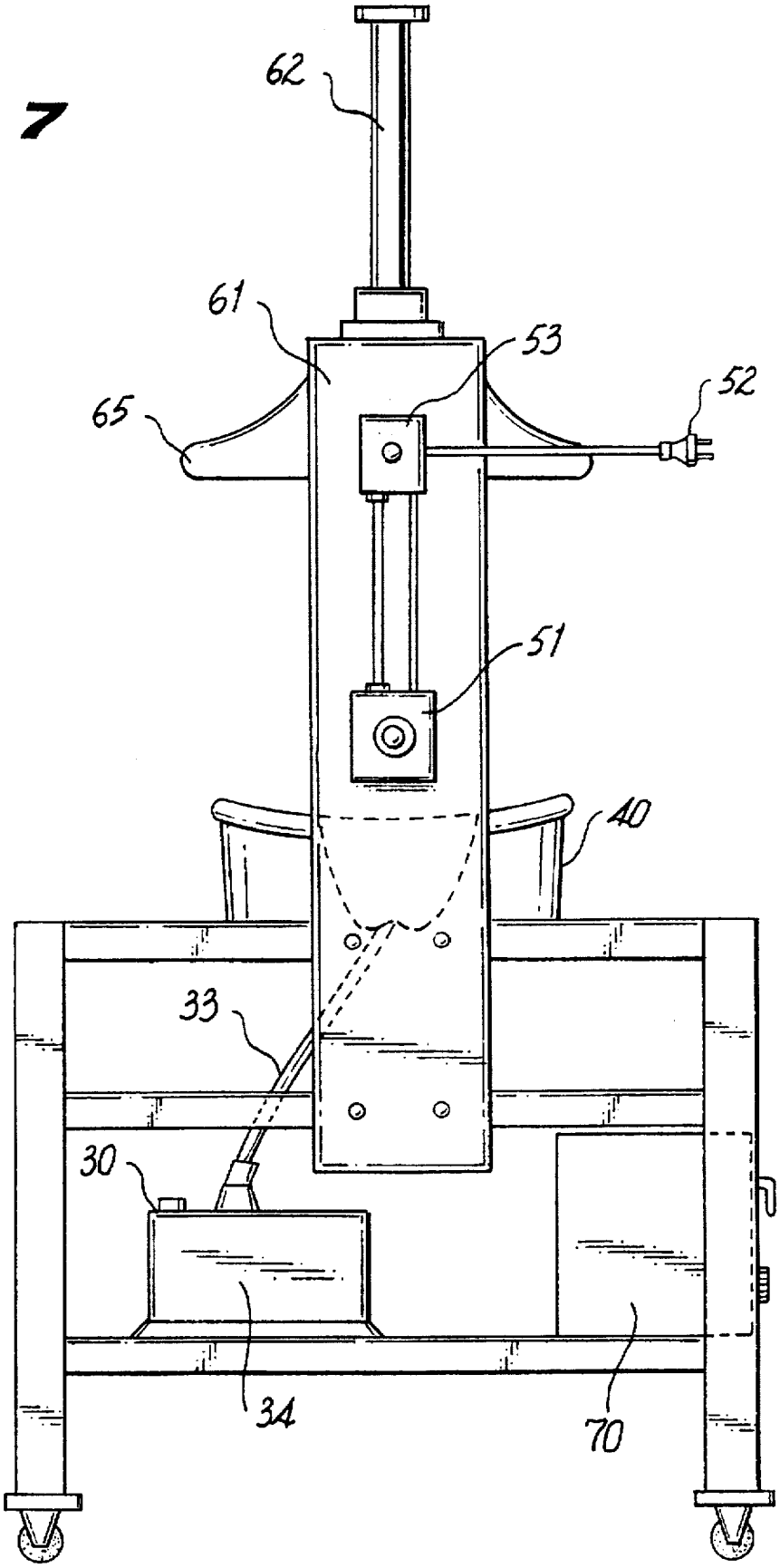
FIG. 7 is a side view of the automatic hat molding machine of the present invention.

FIG. 7 is a side view of the same machine.

It can be appreciated that cylinders 62 can operate independently from cylinder 63 so that physical pressure can be independently applied and controlled to the brim portion and the crown portion of the hat mold. Also, steam entry and heater rod temperature are also independently controlled. The cycle parameters are a function of the felt or wool material, the weight of the felt and the shape and size. The normal sequence of operations is as follows:

raw body is placed in the female mold;

a combination of steam is applied along with heat (typically 4 to 5 seconds);

the movable flange of the male hat mold is advanced down;

the separate male crown mold is advanced down;

the hat is left in the respective mold portions for a time period (of the order of 60 seconds);

the male crown mold portion is moved up away from the female mold;

the male brim flange mold is moved up away from the female mold; and, the molded hat is removed.

Although electric actuators and an electronic programmable controller can be used as a substitute, the preferred embodiment uses pneumatic cylinders and a programmable air control to move the mold pieces and to automate the sequence of operations as shown in the figures. The pneumatic controls and cylinders are cost effective, reliable, and easy to maintain.

Figure 8:
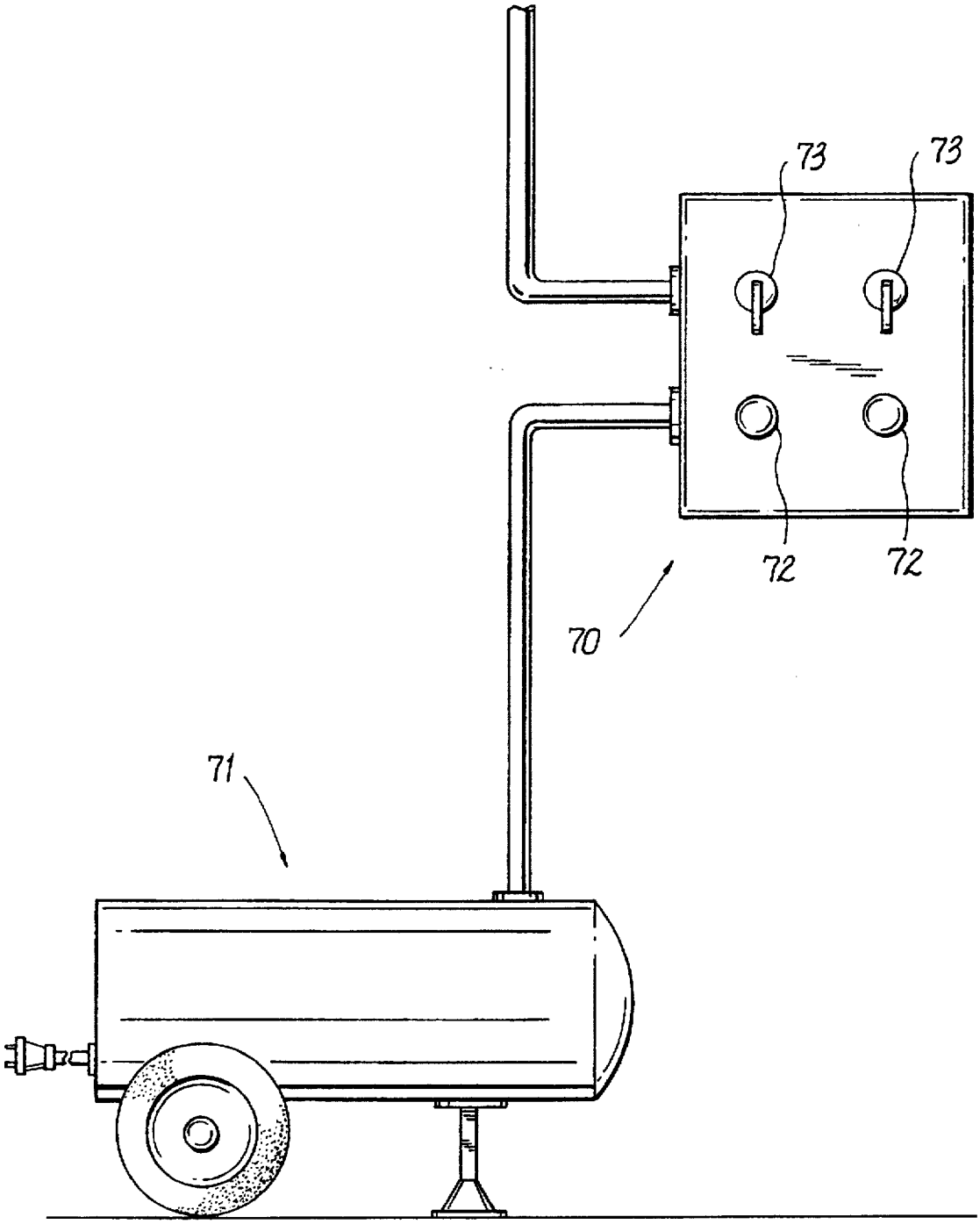
FIG. 8 shows a pneumatic subsystem of the hat making machine of the present invention.

FIG. 8 shows the stand alone electric compressor with integral storage tank connected to the pneumatic console 70. If the machine is used in an environment with available "shop air", a separate compressor would not be required.

Figure 9:
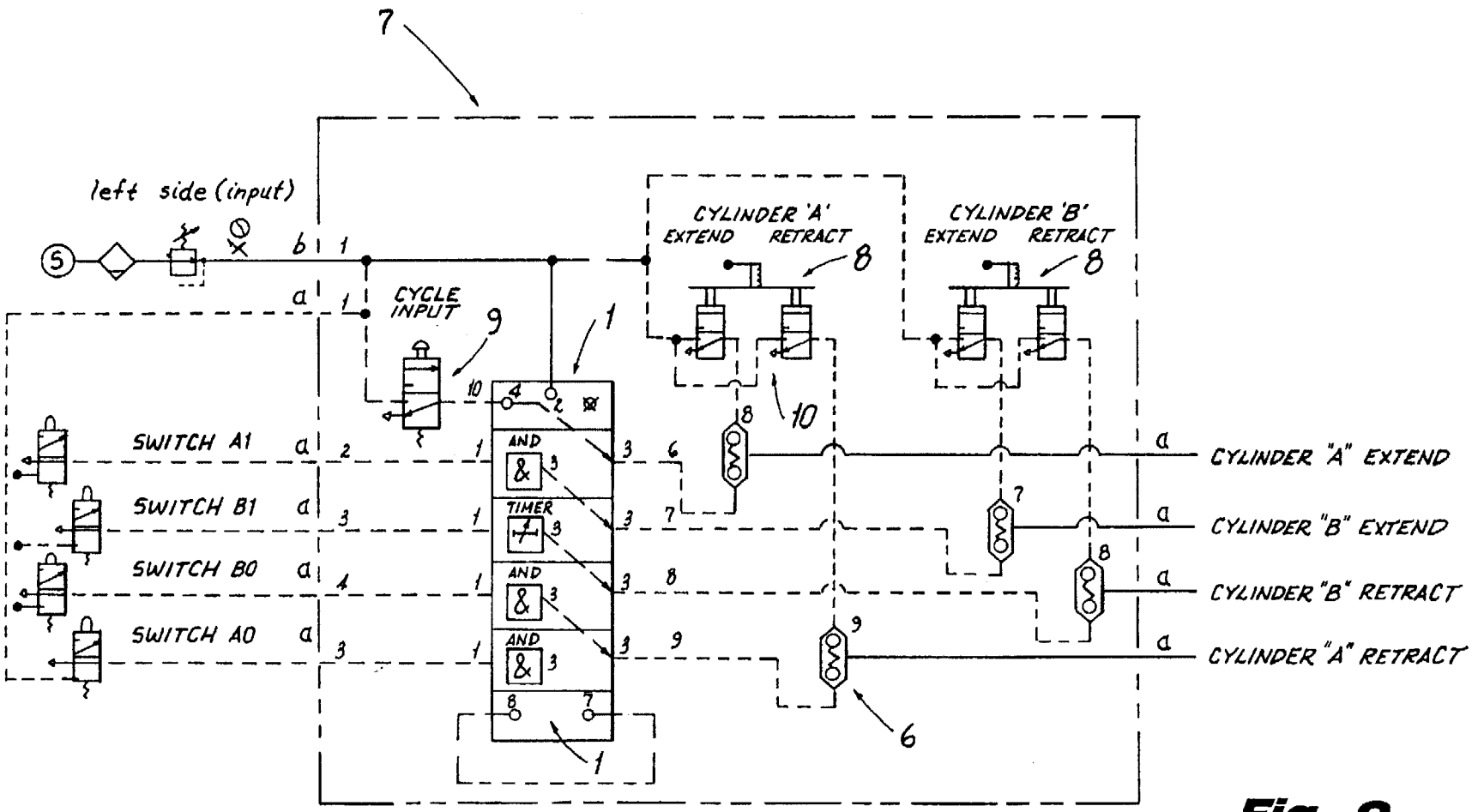
FIG. 9 is a schematic diagram of a programmable air control for the hat making machine of the present invention.

FIG. 9 shows the pneumatic schematic of the programmable air controller. The entry and exit modules 1 of the modular control assembly route the compressed air from the supply through the momentary control button 9 which starts the cycle.

Normally closed switches 10 are used as limit switches (A1, B1, A0, B0) to detect the positions of the cylinder rods in the fully extended or fully retracted positions.

In this nomenclature, cylinder A corresponds to the pair of cylinders 62 in FIG. 6, while cylinder B corresponds to cylinder 63 in FIG. 6. The "&" circuits 4 combine the "complete" signal from the block above with the input from the left in a logical "AND". The timer block 5 behaves like an "&" block with a delayed output where the duration of delay is set by the operator. The pneumatic "OR" elements 6 combine the two inputs to provide an output if either one or both of the inputs are active (i.e. pressurized).

The three-way position selector switches 8 control the direction of the cylinders. The dotted outline 7 denotes an industrial type of enclosure or housing. The sequence of operations corresponding to this schematic supports the movements of the movable die elements as described in the "normal sequence" of operation detailed above.

In addition, pneumatic/electric switches controlled by other blocks in the same air controller (but not detailed in this schematic) are used to control the steam switch and the heater elements in the proper sequence for the desired duration.

Figure 10:
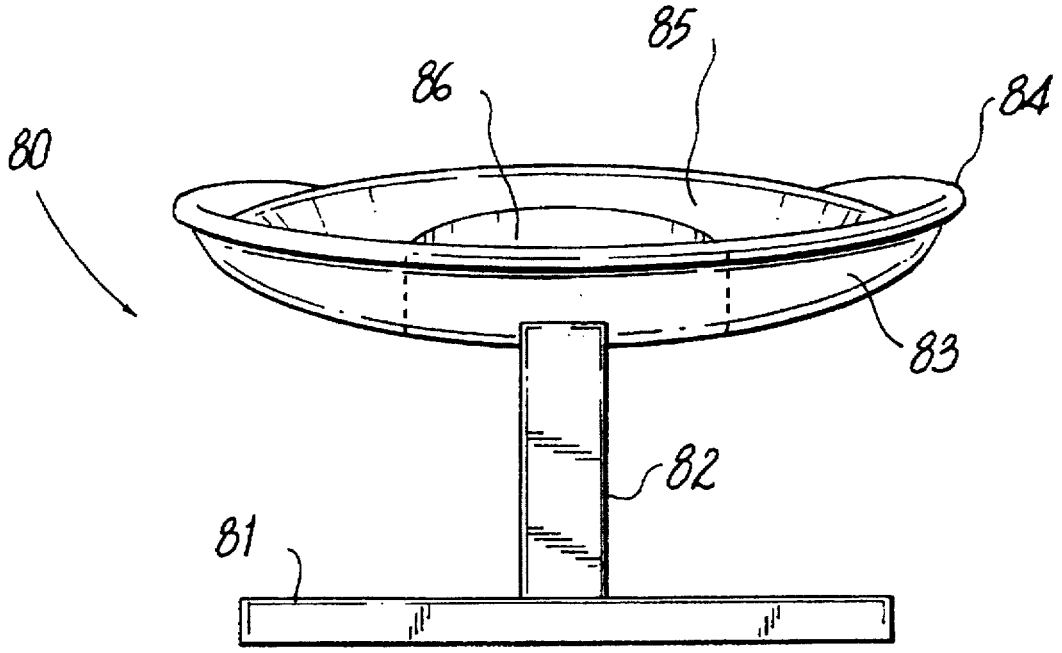
FIG. 10 is a perspective view of the cooling flange rack of the automatic hat molding machine as in FIGS. 6–7, and, FIG. 11 is a perspective view of the cooling flange rack as in FIG. 8, shown with a hat thereon.
Figure 11:
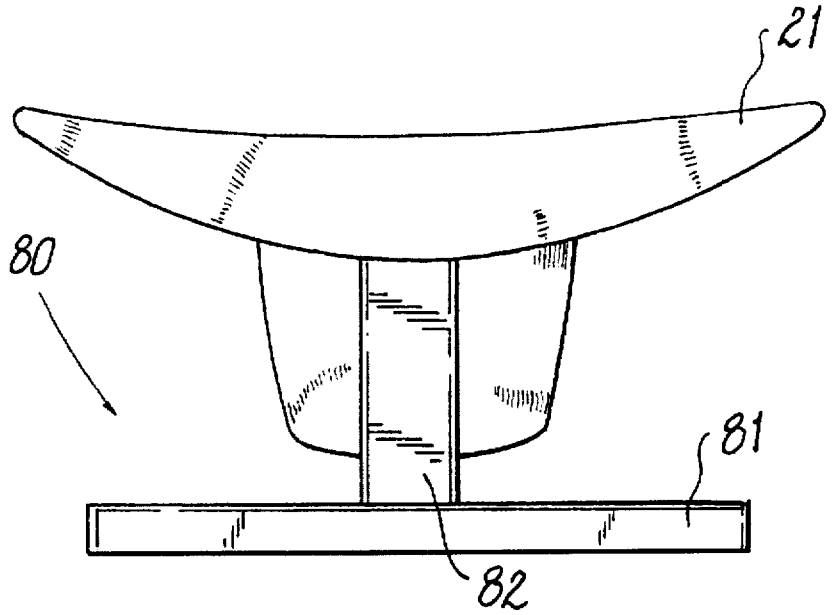

As shown in FIGS. 10–11, when hat 21 is withdrawn from female mold 22 and male mold 23 in a heated condition, it is further shaped on cooling flange rack 80, which includes base 81 supporting post 82, which post 82 supports flange support 83 having outer rim 84, inner rim 85 and hole 86 for insertion of hat 21 therein.

In addition to hat making, the hat making machine of the present invention can be also used for other applications, such as making pressed items, such as floor and wall parts of motor vehicles or other irregularly shaped structures, such as sound proofing panels, by varying the shape of the male and female mold respectively.

It is further know that other modifications may be made to the present invention, without departing from the scope of the invention as noted in the claims herein.

I claim:

1. A hat molding machine using advanced features to produce a completed hat form from an unshaped felt, wool or straw configuration form to a completed hat form shape including a crown shape portion and a flange brim portion, comprising:

a male hat mold and a reciprocal female hat mold, said male hat mold having a first movable brim portion and a separate second movable crown portion, said first movable brim portion of said male hat mold advancable against a corresponding brim portion of said female hat mold, said second movable crown portion of said male hat mold separately advancable in sequence against said flange brim portion of said female hat mold, said male hat mold and said reciprocal female hat mold clamping the raw unshaped hat form in a tight cavity formed therebetween;

said tight cavity between said male hat mold and said female mold being provided sequentially with a source of heat and a source of moisture vapor, said source of heat increasing the temperature of said male hat mold and said female mold to a predetermined temperature for a predetermined period of time;

said source of moisture supplying moisture vapor to said male hat mold at a predetermined pressure and temperature in a gaseous state for a second predetermined period of time;

said source of heat and said source of moisture vapor being provided sequentially for said first and said second predetermined periods of time sufficient to squeeze the raw hat form to the desired completed hat shape; and, a means to vary the sizes of hats made therewith, said means comprising said a plurality of male crown molds corresponding to various sized hats, each of said male crown molds removably insertable within said male hat mold, said means further comprising a plurality of insertion members insertable within said female hat mold, said insertion members reducing a first predetermined volume of said female hat mold to a further smaller predetermined volume of said female hat mold, said further smaller predetermined volume corresponding to a smaller hat size.

2. The hat molding machine as in claim 1, wherein said source of heat comprises at least one electric heating element embedded within said female hat mold, said at least one electric heating element being temperature controlled.

3. The hat molding machine as in claim 1, wherein said source of moisture comprises a source of low pressure steam piping the steam into said female mold.

4. The hat molding machine as in claim 3, wherein said source of low pressure steam is controlled by an automatic programmable air controller with a timer.

5. The hat molding machine as in claim 3, wherein said female mold includes an electrically controlled steam admission valve admitting the steam through a steam port near a base of said female mold, said steam source feeding the steam through a valve to a conduit in communication with said female mold for molding said hat between said male hat mold and said female hat mold.

6. The hat molding machine as in claim 2, wherein said at least one electric heating element comprises at least one heating rod element wrapped around said female mold.

7. The hat molding machine as in claim 6, further comprising a temperature sensor communicating with a thermostat to control said the temperature of said at least one heat rod element.

8. The hat molding machine as in claim 1, wherein said female mold and said male mold move pneumatically.

9. The hat molding machine as in claim 1, wherein said female mold and said male mold move hydraulically.

10. The hat molding machine as in claim 1, wherein said female mold and said male mold move electronically.

11. The hat molding machine as in claim 8, further comprising a pneumatic console receiving compressed air from a source of compressed air, said pneumatic console providing the compressed air through at least one conduit to said male hat mold for moving said male hat mold toward said female hat mold.

12. The hat molding machine as in claim 5, wherein said conduit comprises a plurality of conduits, wherein one conduit of said plurality of conduits independently supplies compressed air against a crown portion of said male hat mold and at least one further conduit independently supplies compressed air against a brim portion of said male hat mold.

13. The hat molding machine as in claim 12, wherein said at least one further conduit comprises a plurality of further conduits supplying compressed air against the brim portion of said male hat mold.

14. The hat molding machine as in claim 11, wherein said source of compressed air is a stand alone portable air compressor.

15. The hat molding machine as in claim 11, wherein said source of compressed air is a connection to a permanent source of compressed air.

16. The hat molding machine as in claim 11, wherein said at least one conduit includes at least one movable member moving said male hat mold between fully extended and fully retracted positions.

17. The hat molding machine as in claim 16, wherein said movement of said at least one movable member is controlled by at least one limit switch, said at least one limit switch detecting relative positions of said movable members for moving said male hat mold in a fully extended or fully retracted position, said at least one limit switch connected to a circuit combining a signal for producing a delayed output where the duration of delay is set by an operator, said circuit having a further switch controlling the direction of said movable members, wherein during the sequence of operations, the movements of said male hat mold is selectively controlled, and an air controller controls said source of moisture vapor and said source of heat in a predetermined sequence for a desired duration of time to form the completed hat.

18. The hat molding machine as in claim 16, wherein said movement of said at least one movable member is controlled by at least one timer to selectively move said at least one movable member independent of other movable members, so that said crown portion of said male hat mold may move independently of said brim portion of said male hat mold.

19. The hat molding machine as in claim 1, further comprising a cooling rack for cooling the completed hat form when the completed hat form is removed from between said male hat mold and said female hat mold.

20. The hat molding machine as in claim 4, wherein said programmable air controller has entry and exit modules for routing compressed air from a compressed air source through a momentary control button to start a cycle of moving said male hat mold toward said female hat mold.

21. A method of making a hat from a raw hat body comprising the steps of:

measuring the raw hat body for an appropriate size and selecting a male crown mold corresponding to the appropriate size from a plurality of various sized male crown molds;

placing the raw hat body in a female mold;

applying steam along with heat to the raw hat body;

moving a movable brim flange mold down over the raw hat body;

moving a male crown mold down over the raw hat body;

leaving the hat thus formed in said molds for a predetermined time period;

moving said male crown mold up away from the hat;

moving said brim flange mold up away from the hat; and, cooling the hat thus formed on a cooling rack, wherein during the sequence of operations, said movements are sequentially controlled in conjunction with said steam and said heat in predetermined sequences for desired duration's of time to form a completed hat.

22. A mold machine using advanced features to produce an item of a finished, pressed state, comprising:

a male mold and a reciprocal female mold, said male mold having a first movable portion and at least one separate second movable portion, said first movable male portion advancable against a corresponding recess of a female mold, said first and said second movable male portions separately advancable in sequence against said female mold, clamping said item therebetween, a cavity between said male mold and said female mold being sequentially provided with a source of heat and a source of moisture vapor, said source of heat increasing the temperature of said male mold and said female mold to a predetermined temperature for a predetermined time, and, said source of moisture supplying moisture vapor to said male mold at a predetermined pressure and temperature for a second predetermined period of time, said source of heat and second source of moisture vapor being provided sequentially for said first and said second predetermined periods of time sufficient to squeeze the item to a desired completed pressed state.

* * * * *